US008215504B2

(12) United States Patent
Marr et al.

(10) Patent No.: US 8,215,504 B2
(45) Date of Patent: Jul. 10, 2012

(54) SUCKER FOR DRINKING PURPOSES

(75) Inventors: Gunter Marr, Rosengarten (DE); Eckard Itzek, Gyhum-Nartum (DE); Elke Ladiges, Hepstedt (DE); Heinz Lischinsky, Rhadereistedt (DE)

(73) Assignee: MAPA GmbH Gummi— und Plastikwerke (DE)

( * ) Notice: Subject to any disclaimer, the term of this patent is extended or adjusted under 35 U.S.C. 154(b) by 352 days.

(21) Appl. No.: 12/066,601

(22) PCT Filed: Aug. 2, 2006

(86) PCT No.: PCT/EP2006/007627

§ 371 (c)(1),
(2), (4) Date: Sep. 23, 2008

(87) PCT Pub. No.: WO2007/031154

PCT Pub. Date: Mar. 22, 2007

(65) Prior Publication Data

US 2009/0039046 A1 Feb. 12, 2009

(30) Foreign Application Priority Data

Sep. 12, 2005 (DE) ..... 20 2005 014 621 U

(51) Int. Cl.
*A61J 11/02* (2006.01)

(52) U.S. Cl. ..... 215/11.4; 215/11.1; 215/11.2; 215/11.3; 215/11.5

(58) Field of Classification Search ..... 215/11.4, 215/11.1, 11.5
See application file for complete search history.

(56) References Cited

U.S. PATENT DOCUMENTS

| | | | | |
|---|---|---|---|---|
| 956,741 | A * | 5/1910 | Smith | 215/11.1 |
| 2,989,961 | A * | 6/1961 | Blanchett | 215/11.5 |
| 3,232,466 | A | 2/1966 | Turanciol | |
| 4,505,398 | A | 3/1985 | Kesselring | |
| 4,613,050 | A * | 9/1986 | Atkin et al. | 215/11.5 |
| 5,117,994 | A | 6/1992 | Leblanc et al. | |
| 5,881,893 | A * | 3/1999 | Manganiello | 215/11.5 |
| 6,959,827 | B2 * | 11/2005 | Morano et al. | 215/396 |
| 2004/0220618 | A1 * | 11/2004 | Rohrig | 606/234 |
| 2007/0131637 | A1 * | 6/2007 | Tamura et al. | 215/11.1 |

FOREIGN PATENT DOCUMENTS

| | | |
|---|---|---|
| DE | 1 804 416 | 12/1959 |
| DE | 8 430 000 U1 | 2/1985 |

(Continued)

OTHER PUBLICATIONS

International Search Report (4 pages).

*Primary Examiner* — Anthony Stashick
*Assistant Examiner* — Cynthia Collado
(74) *Attorney, Agent, or Firm* — Hiscock & Barclay, LLP

(57) ABSTRACT

A bottle teat of an elastic material includes a hollow suction nipple and a circumferential mounting edge for fixation to the bottle opening of a drinking bottle. A hollow transition zone is disposed between the mounting edge and suction nipple as well as at least one drinking slot oriented in the longitudinal direction of the suction nipple and extending from the outside up to the inside of the suction nipple in an outwardly bulged external end region of the suction nipple. The bottle teat further includes at least one ventilation valve with a valve slot which is extended from the outer wall of the transition zone up to the inner wall of the transition zone.

15 Claims, 1 Drawing Sheet

FOREIGN PATENT DOCUMENTS

| | | | |
|---|---|---|---|
| DE | 32 41 845 | C2 | 4/1987 |
| DE | 690 00 247 | T2 | 8/1992 |
| DE | 197 39 911 | C5 | 6/1998 |
| EP | 0151862 | A2 | 8/1985 |
| EP | 1 297 814 | A1 | 4/2003 |
| GB | 2131301 | | 6/1984 |
| JP | 2000000288 | | 1/2000 |
| KR | 200237498 | | 9/2001 |
| WO | WO 97/21414 | A2 | 6/1997 |
| WO | WO 2004/013001 | A2 | 2/2004 |

* cited by examiner

SUCKER FOR DRINKING PURPOSES

CROSS REFERENCE TO RELATED APPLICATIONS

This application is based upon and claims priority under 35 USC §119 to PCT/EP2006/007627, filed Aug. 2, 2006 entitled: A BOTTLE TEAT, which is based upon German Patent Application No. 20 2005 014 621.8, filed Sep. 12, 2005 entitled: A BOTTLE TEAT. The entire contents of each above noted application is herein incorporated by reference.

FIELD OF THE INVENTION

The invention relates to a bottle teat made from an elastic material.

BACKGROUND OF THE INVENTION

Bottle teats serve the nutrition of sucklings and infants. Known bottle teats have a high suction nipple and a circumferential edge for fixation to a bottle opening of a drinking bottle. Since the mounting edge has a cross-section larger than that of the suction nipple a hollow transition area is present between the suction nipple and the mounting edge and generally expands from the suction nipple to the mounting edge. At its end region, the suction nipple has a drinking hole through which liquid can exit. A ventilation valve with a valve slot is within the transition area. The bottle teat is fixed to the aperture rim of the drinking bottle by means of a threaded ring. To this end, the bottle teat is slid through the threaded ring until the mounting edge comes to seat below an annular flange of the threaded ring. The threaded ring is screwed onto a male thread of the drinking bottle, by which action the mounting edge is sandwiched between the aperture rim and the threaded ring. Likewise, it is known to configure the ventilation valve by placing suitable channels in the seat range of the mounting edge at the aperture rim of the drinking bottle.

The infant can withdraw the liquid or other fluid food with which the drinking bottle is filled, by sucking at the suction nipple. This causes the food to exit through the drinking hole and a pressure balance takes place with the surroundings via the ventilation valve.

These known bottle teats have the disadvantage that they only enable a small flow of the food to be provided. If the drinking hole is constructed too large the liquid can flow out with no suction work performed by the infant. As a result, the infant is not trained in taking food and the food might come to be spilled. Further, the taking of food is restricted by the ventilation valve which limits the pressure balance.

From WO 2004/013001 A2, a spill-proof drinking cup is known where the suction nipple has a hollow with parallel drinking slots. When the user bites onto the outer walls of the suction nipple the insides thereof urge against the bottom of the hollow, which will open the drinking slots disposed in the bottom of the hollow. This spill-proof drinking cup is not suited for use by sucklings and infants because they are unable to open the drinking slots by biting onto the suction nipple. Moreover, this drinking cup does not support the suckling's or infant's natural suction work.

SUMMARY OF THE INVENTION

Accordingly, it is the object of the invention to provide a bottle teat made of an elastic material which enables an increased flow of the food to be provided without adversely affecting the natural suction process, and which still prevents any unintentional spill of food in an efficient way.

The object is achieved by a bottle teat of an elastic material having a hollow suction nipple, a circumferential mounting edge for fixation to the bottle opening of a drinking bottle, a hollow transition zone between the mounting edge and suction nipple, at least one drinking slot oriented in the longitudinal direction of the suction nipple and extended from the outside up to the inside of the suction nipple in an outwardly bulged external end region of the suction nipple, and at least one ventilation valve with a valve slot which is extended from the outer wall of the transition zone up to the inner wall of the transition zone.

In the inventive bottle teat, the drinking slot in the suction nipple ensures an increased flow of the food to be provided. This is the case already when a single drinking slot of appropriate dimensions exists because it allows for a higher throughput than does a drinking hole. Since the drinking slot is located in an outwardly bulged end region of the bottle teat the withdrawal of food requires that suction work be done. Unlike in the state of the art, the withdrawal of food does not presuppose that the bottle teat be clenched. An adequate pressure balance is also possible through an appropriately sized valve slot.

According to an aspect, the suction nipple has at least two parallel drinking slots. The two parallel drinking slots ensure a particularly large throughput of the food to be provided when the infant sucks at the bottle teat.

According to an aspect, the at least one drinking slot is rectilinear and/or undulated and/or serrated. Rectilinear drinking slots are particularly easy to manufacture by mechanically slitting the bottle teat. Undulated or serrated drinking slots favour a particularly high throughput of the food to be provided because they may be configured within a small space of a particularly large efficient length. The invention further encompasses designs where the drinking slot is rectilinear or undulated or serrated only in at least one sub-region and is of another one of the shapes mentioned above or a different shape in at least another sub-region.

The invention embraces designs where the suction nipple is disposed centrally with respect to the mounting edge. According to an aspect, the suction nipple is disposed eccentrically with respect to the mounting edge. This favours a complete withdrawal of food from the drinking bottle when the bottle is rotated such as to arrange the suction nipple at bottom. This design is particularly beneficial ergonomically.

According to an aspect, the suction nipple is of a cross-section which tapers off towards the outer end. This specifically makes manufacture easier and is particularly beneficial ergonomically. This also applies to another aspect according to which the suction nipple is of an oval cross-section. This further applies to an aspect where one side of the suction nipple that is closest to the mounting edge has a lesser inclination from the nipple axis than has the side of the suction nipple that is farthest distant from the mounting edge. Particularly for reasons of easy manufacture and ergonomy, according to a further aspect, the suction nipple has a rounded portion towards the transition zone on the side distant from the mounting edge.

To prevent the bottle teat from collapsing in the area of the rounded portion, the rounded portion and, selectively, the adjacent transition zone carry a rib on the inside.

According to an aspect, the transition zone is domed. This is also beneficial for reasons of easy manufacture and ergonomy.

According to an aspect, a circumferential constriction is present between the mounting edge and transition zone. This stabilizes the bottle teat above the constriction and prevents its excessive deformation which can impede the withdrawal of food.

According to an advantageous aspect, there are at least two ventilation valves to ensure good pressure balance.

According to an aspect, the ventilation valve is located in a depression of the transition zone. This particularly counteracts an unintentional exit of food through the valve slot. Further, the protected accommodation of the ventilation valve inside the depression favours a smooth operation of the ventilation valve.

According to an aspect, the depression is present in the outer edge of the domed transition zone.

According to an aspect, the ventilation valve is located diametrically opposite the suction nipple in the outer edge of the transition zone. This helps achieve that if the suction nipple is arranged at bottom the ventilation valve will not be wetted with food so that a smooth pressure balance is possible.

According to an aspect, the mounting edge has a mounting flange. This favours a sealing fixation of the mounting edge between the threaded ring and the aperture rim of the bottle.

According to a further aspect, the mounting flange has a circumferential boss on the inner edge. The circumferential boss, in conjunction with a suitable threaded ring, prevents the bottle teat from inadvertently being pulled out of the threaded ring. Possible aspects of the bottle teat with a boss or another thickened region and a threaded ring matching it are described in DE 197 39 911 C5 the disclosure of which is incorporated into the present application to some extent.

According to a further aspect, the mounting edge is annularly circular.

Finally, according to an aspect, the bottle teat is manufactured from natural rubber or silicone.

It is preferred that the bottle teat is manufactured from one of the aforementioned materials. However, designs are also incorporated here which are made from several materials connected to each other.

The bottle teat preferably is manufactured from natural rubber, e.g. in a dipping process with aluminum moulds and a subsequent after-treatment and curing. The drinking and valve slots preferably are introduced by mechanical slitting.

BRIEF DESCRIPTION OF THE DRAWINGS

The invention will be described in more detail below with reference to the accompanying drawings. In the drawings.

DETAILED DESCRIPTION

The bottle teat 1 has a hollow suction nipple 2 which, via a hollow transition area 3, is joined to a mounting edge 4 for fixation to the opening area of a bottle.

Figure 1:
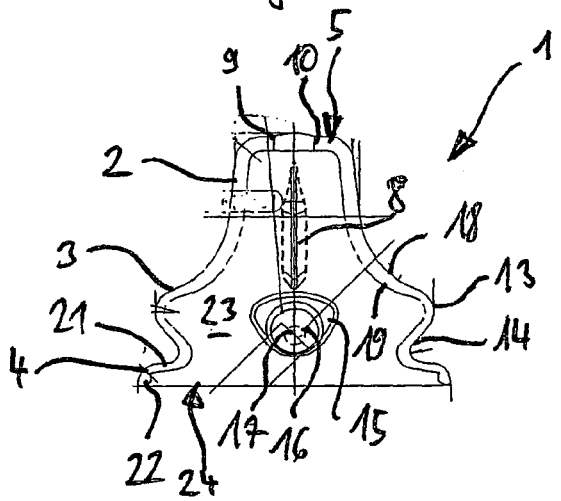
FIG. 1 shows the bottle teat in a vertical section.
Figure 2:
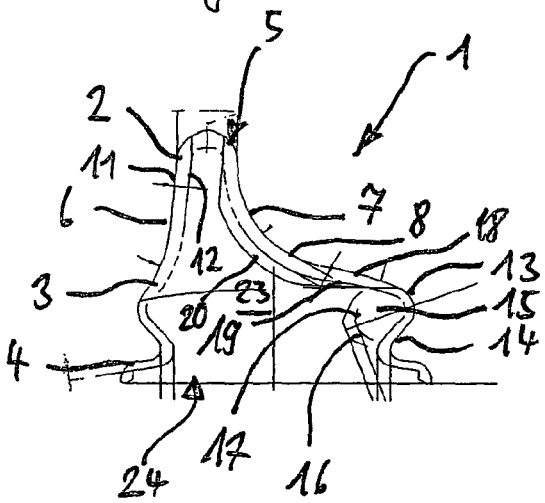
FIG. 2 shows the same bottle teat in a vertical section offset by 90°.
Figure 3:
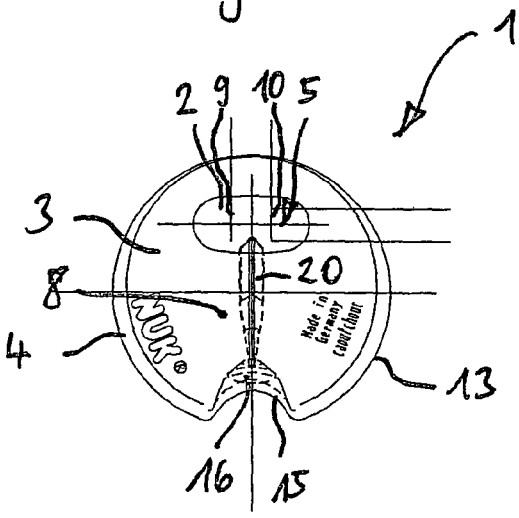
FIG. 3 shows the same bottle teat in a plan view.

The suction nipple 2 is of an oval cross-section which tapers towards its outer end region 5 (see FIG. 3). The side 6 of the suction nipple 2 that is closest to the mounting edge 4 has a lesser inclination from the nipple axis than has the opposite side 7 of the suction nipple 2 that is farthest distant from the mounting edge 4. The side 7 of the suction nipple 2 extends to terminate in a concave rounded portion 8 towards the transition area 3.

The outer end region 5 of the suction nipple 2 is bulged outwardly, i.e. is domed. The outer end region 5 has disposed therein two parallel slots 9, 10 which are oriented perpendicularly to the sides 6, 7 of the suction nipple 2. The slots 9, 10 extend from the outer wall 11 up to the inner wall 12 of the suction nipple 2.

The suction nipple 2 gradually passes over into the transition area 3. Within the transition area 3, the bottle teat 1 gradually expands to the larger diameter of the mounting edge 4. The transition area 3 has a circumferential outer edge 13. A circumferential constriction 14 is present between the edge 13 and the mounting edge 4.

Within the area of the circumferential outer edge 13, a depression 15 exists diametrically opposite the suction nipple 2 disposed eccentrically with respect to the mounting edge 4. The depression 15 accommodates a ventilation valve 16. The ventilation valve 16 has a valve slot 17. The valve slot 17 extends from the outer wall 18 up to the inner wall 19 of the transition area 3.

The inside of the rounded region 8 has a rib 20 which is extended in parallel with the drinking slots 9, 10.

The mounting edge 4 comprises a mounting flange 21 which has a circumferential boss 22 on its lower edge.

The interior of the bottle teat 1 houses a cavity 22 which extends from the opening 24 bordered by the mounting flange 4 through the transition area 3 and the suction nipple 2 up to the drinking slots 9, 10.

For use, the bottle teat 1 is attached, by means of a threaded ring which is not shown, to a drinking bottle which is not shown and is filled with liquid food. The attachment device is formed, for example, in the way shown in FIG. 4 of DE 197 39 911 C5 and is explained in the pertinent description of figures the disclosure of which is incorporated in the present application.

During food withdrawal, the drinking bottle is held so as to cause the suction nipple 2 to obliquely face downwards with the suction nipple 2 located at the lower edge of the drinking bottle. The two drinking slots 9, 10 allow for a particularly high flow rate when the infant sucks at the suction nipple. The configuration and dimensions of the ventilation valve 16 also favours a pressure balance and, hence, a high flow rate.

The invention claimed is:

1. A bottle teat made from an elastic material, said teat comprising:

a hollow suction nipple, a circumferential mounting edge for fixation to the bottle opening of a drinking bottle, a hollow transition zone between the mounting edge and suction nipple, at least one drinking slot oriented in the longitudinal direction of the suction nipple and extended from the outside up to the inside of the suction nipple in an outwardly bulged external end region of the suction nipple, and at least one ventilation valve having a valve slot which is extended from the outer wall of the transition zone up to the inner wall of the transition zone, said at least one ventilation valve, including said valve slot, being entirely located diametrically opposite the suction nipple and in which said suction nipple has an oval cross-section; and the suction nipple is disposed eccentrically with respect to the mounting edge, said bottle teat being manufactured from at least one of natural rubber and silicone.

2. The bottle teat according to claim 1 wherein the suction nipple has at least two parallel drinking slots.

3. The bottle teat according to claim 1 wherein the drinking slot is at least one of rectilinear, undulated and serrated.

4. The bottle teat according to claim 1 wherein the hollow suction nipple is defined by a cross-section, said cross section tapering inwardly towards an outer end.

5. The bottle teat according to claim 1 wherein one side of the suction nipple that is closest to the mounting edge has a lesser inclination from the nipple axis than the side of the suction nipple that is furthest from the mounting edge.

6. The bottle teat according to claim 1 wherein the suction nipple has a rounded portion towards the transition zone on the side distant from the mounting edge.

7. The bottle teat according to claim 6 wherein the rounded portion and, optionally, the adjacent transition zone carry a rib on the inside.

8. The bottle teat according to claim 1 wherein the transition zone is domed.

9. The bottle teat according to claim 1 wherein a circumferential constriction is present between the mounting edge and the transition zone.

10. The bottle teat according to claim 1 wherein the ventilation valve is located in a depression of the transition zone.

11. The bottle teat according to claim 10 wherein the depression is present in the outer edge of the domed transition zone.

12. The bottle teat according to claim 1 wherein the mounting edge has a mounting flange.

13. The bottle teat according to claim 12 wherein the mounting flange has a circumferential boss on an inner edge thereof.

14. The bottle teat according to claim 1 wherein the mounting edge is annularly circular.

15. A bottle teat made from an elastic material, said teat comprising:

a hollow suction nipple having an oval cross-section;

a circumferential mounting edge for fixation to the bottle opening of a drinking bottle;

a hollow transition zone between the mounting edge and suction nipple, at least one drinking slot oriented in the longitudinal direction of the suction nipple and extended from the outside up to the inside of the suction nipple in an outwardly bulged external end region of the suction nipple; and at least one ventilation valve with a valve slot which is extended from the outer wall of the transition zone up to the inner wall of the transition zone, said ventilation valve, including said valve slot, being entirely located diametrically opposite the suction nipple in the outer edge of said transition zone and in which said suction nipple is disposed eccentrically with respect to the mounting edge, said bottle teat being manufactured from at least one of natural rubber and silicone.

* * * * *